US008235613B2

(12) United States Patent
Hosono

(10) Patent No.: US 8,235,613 B2
(45) Date of Patent: Aug. 7, 2012

(54) LABEL PRINTER HAVING A CUTTER MECHANISM FOR CUTTING A STRIP-FORM PRINTING MEDIUM

(75) Inventor: Shinichiro Hosono, Petaling Jaya Selangor D.E. (MY)

(73) Assignee: Kabushiki Kaisha Sato, Tokyo (JP)

( * ) Notice: Subject to any disclaimer, the term of this patent is extended or adjusted under 35 U.S.C. 154(b) by 536 days.

(21) Appl. No.: 12/524,860

(22) PCT Filed: Jan. 28, 2008

(86) PCT No.: PCT/JP2008/051204

§ 371 (c)(1),
(2), (4) Date: Jul. 29, 2009

(87) PCT Pub. No.: WO2008/093635

PCT Pub. Date: Aug. 7, 2008

(65) Prior Publication Data

US 2010/0119283 A1 May 13, 2010

(30) Foreign Application Priority Data

Jan. 31, 2007 (JP) ..... 2007-021623

(51) Int. Cl.
*B41J 29/13* (2006.01)
*B41J 11/70* (2006.01)
*B41J 29/00* (2006.01)

(52) U.S. Cl. ..... 400/621; 400/691; 400/693

(58) Field of Classification Search ..... 400/621, 400/693, 120.01; 347/222, 217; 621/621, 621/693; *B41J 11/66, 11/70*

See application file for complete search history.

(56) References Cited

U.S. PATENT DOCUMENTS

| | | | | |
|---|---|---|---|---|
| 5,135,318 | A | 8/1992 | Hongo | |
| 6,155,730 | A * | 12/2000 | Nakayama et al. | 400/613 |
| 6,443,645 | B1 * | 9/2002 | Takei et al. | 400/621 |
| 6,955,488 | B2 * | 10/2005 | Uehara | 400/692 |
| 2003/0103793 | A1 | 6/2003 | Murakoshi | |
| 2005/0123336 | A1 | 6/2005 | Oshida | |

FOREIGN PATENT DOCUMENTS

| | | | |
|---|---|---|---|
| EP | 1506875 | A | 2/2005 |
| JP | 9-086002 | | 3/1997 |
| JP | 10-000592 | | 1/1998 |
| JP | 11-000892 | A | 1/1999 |
| JP | 11-245194 | A | 9/1999 |
| JP | 11-245465 | A | 9/1999 |
| JP | 11-245476 | A | 9/1999 |
| JP | 2001-205896 | A | 7/2001 |
| JP | 2002-370417 | A | 12/2002 |
| JP | 2003089247 | A * | 3/2003 |
| JP | 2003-191543 | A | 7/2003 |
| JP | 2005254620 | A * | 9/2005 |
| JP | 2005329597 | A * | 12/2005 |
| JP | 2006-123191 | A | 5/2006 |

* cited by examiner

*Primary Examiner* — Daniel J Colilla
(74) *Attorney, Agent, or Firm* — SOLARIS Intellectual Property Group, PLLC

(57) ABSTRACT

A label printer includes a cutter mechanism, a main body frame, and an upper cover. The cutter mechanism includes an upper blade which is a fixed blade and a lower blade which is a moving blade that advances and retreats relative to the upper blade, and that cuts a printing medium by causing the lower blade to advance and retreat relative to the upper blade. The lower blade is attached to the main body frame. The upper blade is attached to the upper cover, which opens and closes an upper portion of the main body frame. The upper blade is separated from the lower blade when the upper cover is opened.

4 Claims, 6 Drawing Sheets

LABEL PRINTER HAVING A CUTTER MECHANISM FOR CUTTING A STRIP-FORM PRINTING MEDIUM

TECHNICAL FIELD

The present invention relates to a label printer having a cutter mechanism for cutting a strip-form printing medium, and more particularly to a label printer having a guillotine type cutter mechanism for cutting a strip-form printing medium by causing a lower blade to advance and retreat relative to an upper blade.

BACKGROUND ART

Conventionally, a label printer having an upper blade and a lower blade that advances and retreats relative to the upper blade is used as a cutter mechanism for cutting a strip-form printing medium, on which printing has been implemented, at a predetermined position (see Patent Document 1, for example).

However, with this conventional technique, a complicated operation must be performed to pass the strip-form printing medium through a gap between the upper blade and lower blade of the cutter mechanism when setting the printing medium.

Patent Document 1: Japanese Patent Application Laid-Open No. 11-892

DISCLOSURE OF THE INVENTION

Problem to Be Solved by the Invention

The present invention has been achieved in consideration of this problem, and the object thereof is to provide a label printer in which a strip-form printing medium can be set easily without performing a complicate operation to pass the printing medium through a gap between an upper blade and a lower blade of a cutter mechanism.

Means for Solving the Problem

In order to solve the problem described above, the present invention is configured as follows.

In a first aspect of the present disclosure, a label printer is provided having a cutter mechanism that includes an upper blade serving as a fixed blade and a lower blade serving as a moving blade that advances and retreats relative to the upper blade, and cuts a printing medium by causing the lower blade to advance and retreat relative to the upper blade. The label printer includes: a body frame to which the lower blade is attached; and an upper cover to which the upper blade is attached, and opens and closes an upper portion of the body frame, wherein the upper blade is separated from the lower blade when the upper cover is opened.

The label printer may further include an upper frame to which a thermal head and an ink ribbon conveyance mechanism are attached and provided between the upper cover and the body frame; and integrating unit that integrates the upper cover and the upper frame, wherein the upper cover and the upper frame are attached so as to be rotatable about a same support shaft provided in the body frame, and the upper cover and the upper frame are integrally rotatable when integrated by the integrating unit, and are independently rotatable when the integration of the upper cover and the upper frame by the integrating unit is released.

The label printer may be configured such that the upper blade is attached to an upper blade holder, the upper blade holder is pivotably attached to the upper cover, and a sliding contact piece that slidably contacts the upper portion frame when the upper cover and the upper frame are independently rotated is provided at the upper blade holder, such that when the sliding contact piece slidably contacts the upper frame, the upper blade holder pivots, whereby the upper cover and the upper frame can be separated while avoiding contact between the upper blade and the upper frame.

Effect of the Invention

In the label printer of the present invention, the body frame attached with the lower blade and the upper cover attached with the upper blade, for opening and closing the upper portion of the body frame, are provided and the upper blade is separated from the lower blade when the upper cover is opened. Hence, a wide opening can be formed between the upper blade and lower blade when the upper cover is opened, and therefore a strip-form printing medium can be set easily without performing a complicate operation to pass the printing medium through a gap between the upper blade and the lower blade of the cutter mechanism.

Further, in the label printer of the present invention, by attaching the upper cover and the upper frame, which is provided between the upper cover and the body frame and to which the thermal head and the ink ribbon conveyance mechanism are attached, rotatable about a same support shaft provided in the body frame, and providing the integrating unit that integrates the upper cover and the upper frame, the upper cover and upper frame can be integrally rotated due to the integration by the integrating unit and can be independently rotated by releasing the integration by the integrating unit. Thus, a wide opening can be formed between the body frame and the upper cover and upper frame when the upper cover and the upper frame are integrally rotated due to the integration by the integrating unit, whereby a sheet roll can be easily loaded into a supply portion of the body frame through the gap between the body frame and the upper frame and upper cover, and a wide opening can be formed between the upper cover and the upper frame when the upper cover and the upper frame are independently rotated by releasing the integration by the integrating unit, whereby a cleaning operation of the thermal head and a replacement operation of an ink ribbon can be performed at a position that is not interfered with by the upper blade attached to the upper cover, which results in an effect of improvement in maintenance workability.

Furthermore, in the label printer of the present invention, the upper blade is attached to the upper blade holder, the upper blade holder is pivotably attached to the upper cover, and the sliding contact piece that slidably contacts the upper frame when the upper cover and the upper frame are independently rotated is provided at the upper blade holder. Hence, when the sliding contact piece slidably contacts the upper frame, the upper blade holder pivots due to an external force from the upper frame and the upper cover and the upper frame can be separated while avoiding contact between the upper blade and the upper frame. Therefore, the shape of the upper frame is not restricted by the trajectory of the upper blade when opening the upper cover, and as a result, an improvement in design freedom can be achieved.

BEST MODE FOR CARRYING OUT THE INVENTION

An embodiment of the present invention will be described in detail below on the basis of the drawings.

Figure 1:
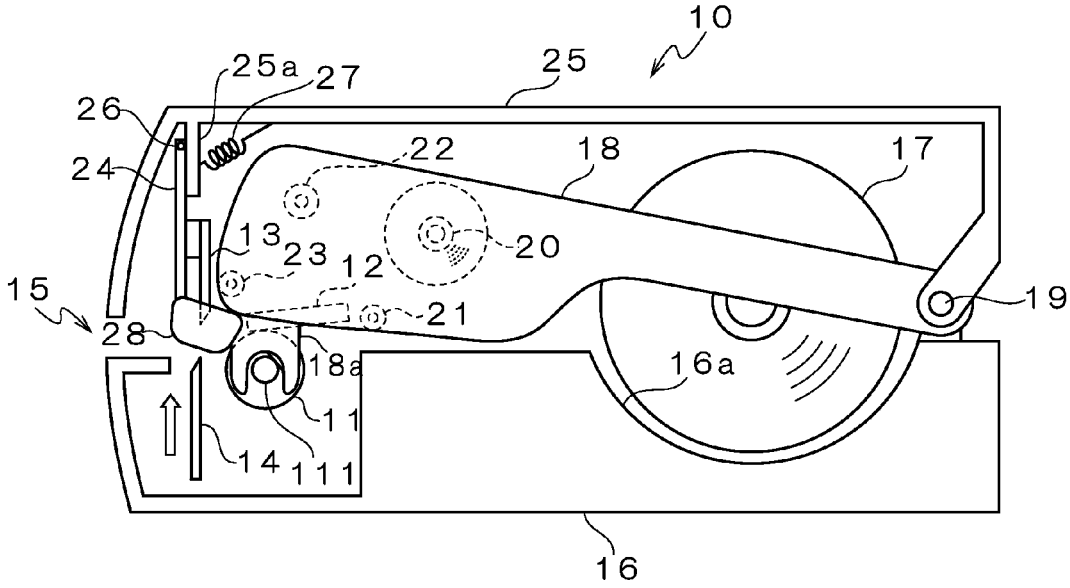
FIG. 1 is a schematic side view showing a constitution of a label printer, which is in a closed state, according to an embodiment of the present invention.
Figure 2:
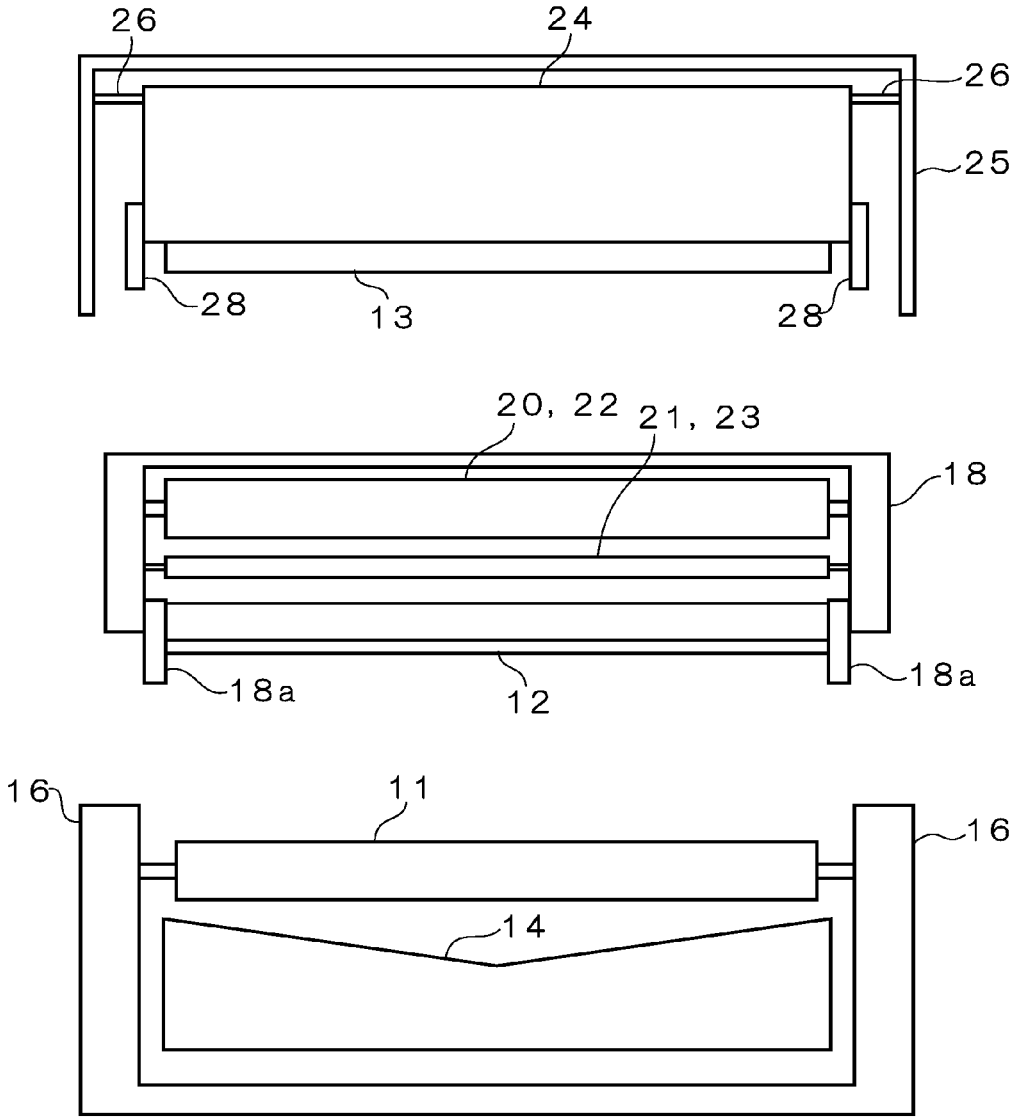
FIG. 2 is a schematic diagram showing positional relationships in a width direction between constitutions provided in a body frame, an upper frame, and an upper cover shown in FIG. 1.
Figure 3A:
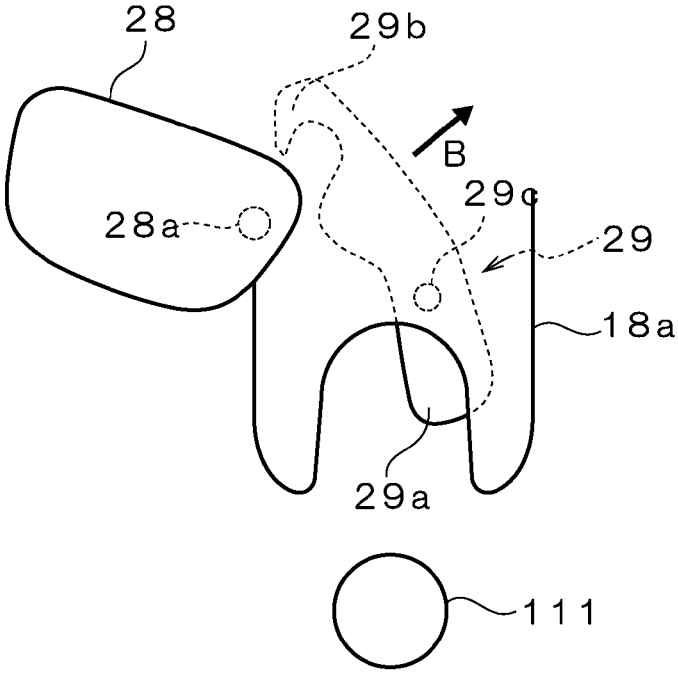
FIGS. 3A and 3B are views showing configurations of a latch portion provided at an engagement portion shown in FIG. 1.
Figure 3B:
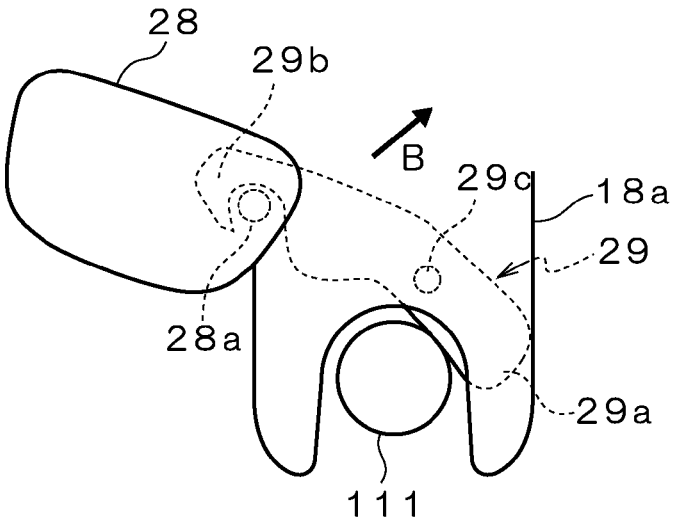
Figure 4:
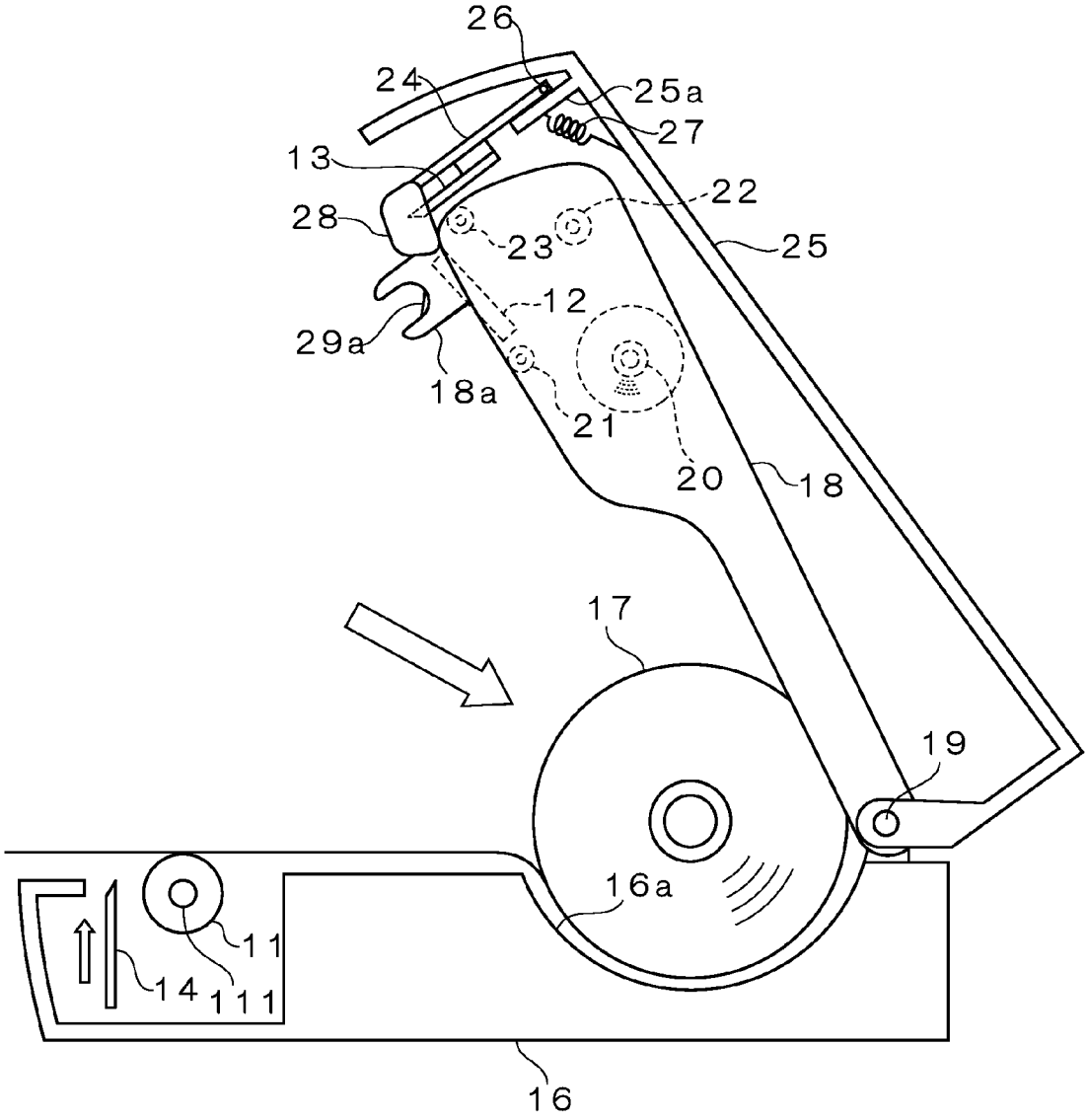
FIG. 4 is a schematic side view showing the label printer according to the embodiment of the present invention in an open state obtained by integrally rotating the upper frame and the upper cover.
Figure 5:
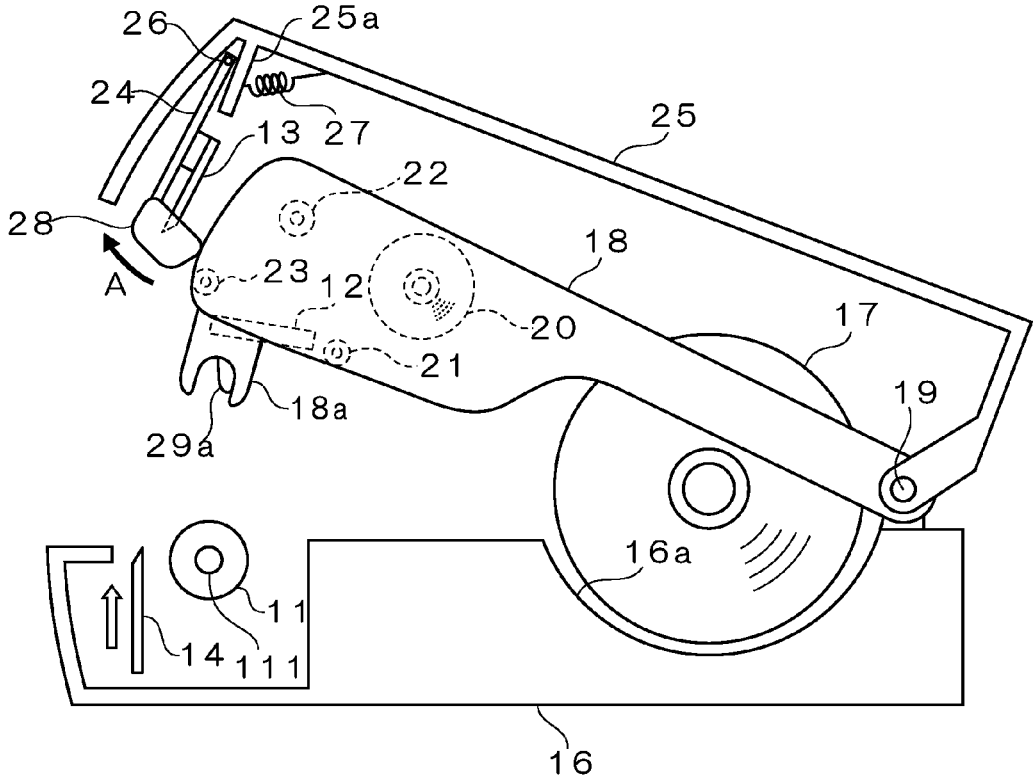
FIG. 5 is a schematic side view illustrating a pivoting motion of an upper blade holder shown in FIG. 1.
Figure 6:
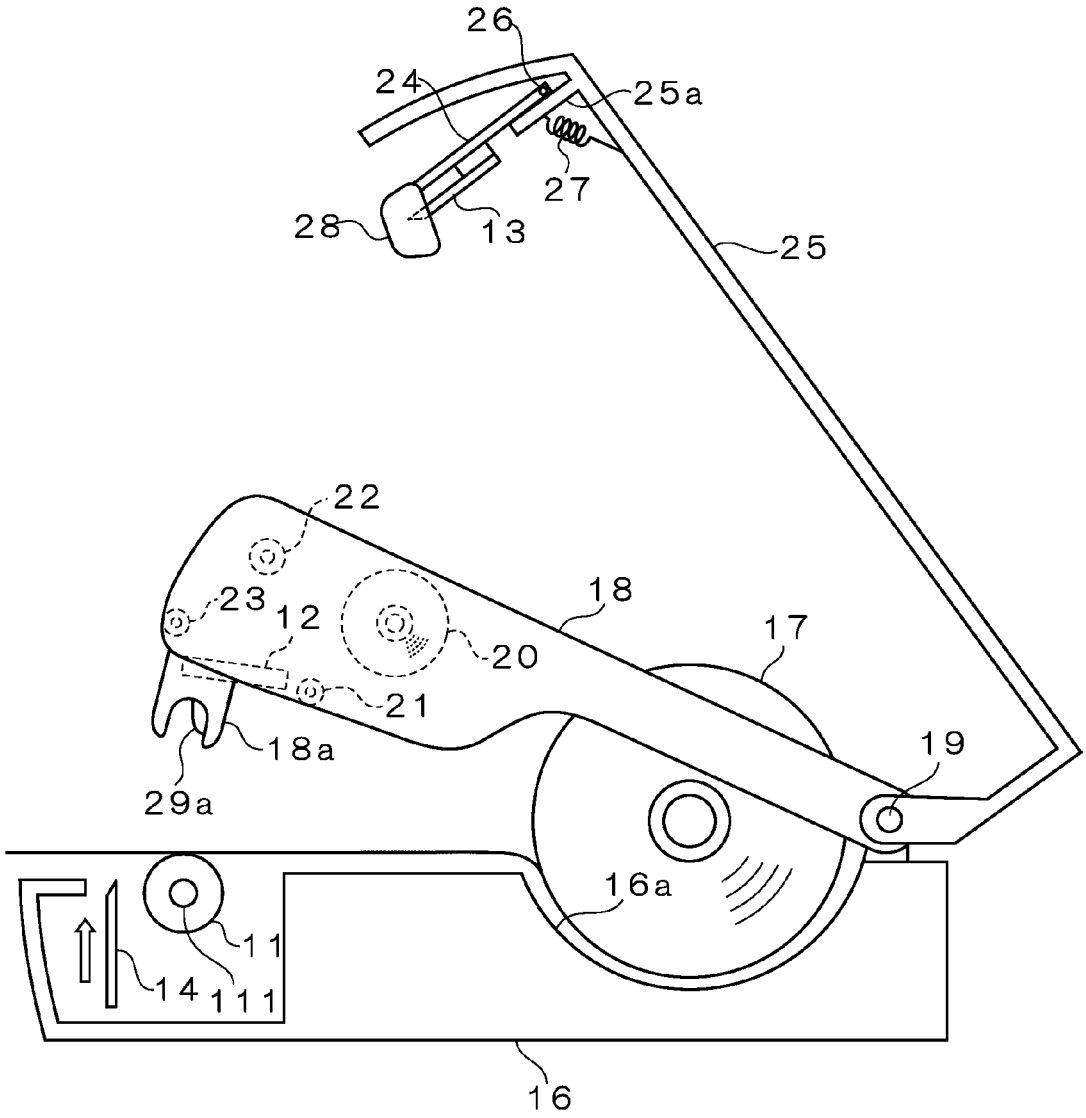
FIG. 6 is a schematic side view showing the label printer according to the embodiment of the present invention in an open state obtained by independently rotating the upper frame and the upper cover.

FIG. 1 is a schematic side view showing a configuration of a label printer, which is in a closed state, according to an embodiment of the present invention. FIG. 2 is a schematic diagram showing positional relationships in a width direction between constitutions provided in a body frame, an upper frame, and an upper cover shown in FIG. 1. FIGS. 3A and 3B are views showing configurations of a latch portion provided at an engagement portion shown in FIG. 1. FIG. 4 is a schematic side view showing the label printer according to the embodiment of the present invention in an open state obtained by integrally rotating the upper frame and the upper cover. FIG. 5 is a schematic side view illustrating a pivoting motion of an upper blade holder shown in FIG. 1. FIG. 6 is a schematic side view showing the label printer according to the embodiment of the present invention in an open state obtained by independently rotating the upper frame and the upper cover.

Referring to FIGS. 1 and 2, a label printer 10 according to the present embodiment includes a printing mechanism including a platen roller 11 and a thermal head 12 in which a heat generating body is formed on a surface facing the platen roller 11, and a guillotine type cutter mechanism including an upper blade 13 which is a fixed blade and a lower blade 14 which is a moving blade that advances and retreats relative to the upper blade 13. In the label printer 10, a strip-form printing medium such as a label continuous body, in which labels are detachably adhered to a strip-form mounting sheet with intervals, and an ink ribbon are overlapped and conveyed between the platen roller 11 and the thermal head 12, printing is performed thereon by causing the heat generating body of the thermal head 12 to selectively generate heat so that ink is transferred onto a printing surface of the printing medium from the ink ribbon. The printing medium is then cut by causing the lower blade 14 to advance and retreat relative to the upper blade 13, and the printed and cut printing medium is output from a discharge port 15.

The platen roller 11 of the printing mechanism and the lower blade 14 of the cutter mechanism are attached to a body frame 16, and a supply portion 16*a* to which a sheet roll 17 formed by the strip-form printing medium wound into a roll is loaded, is provided in the body frame 16.

The thermal head 12 and an ink ribbon conveyance mechanism are attached to an upper frame 18, and the upper frame 18 is supported to be freely rotatable by a support shaft 19 provided in a rear side of the body frame 16. Thus, the upper frame 18 can be rotated in a direction in which the thermal head 12 is separated from the platen roller 11 which is attached to the body frame 16. The ink ribbon conveyance mechanism attached to the upper body frame 18 includes a ribbon sheet supply shaft 20 to which the ink ribbon wound into a roll is attached, a guide roller 21 for guiding the ink ribbon fed from the ribbon sheet supply shaft 20 between the platen roller 11 and the thermal head 12, a ribbon winding shaft 22 onto which the ink ribbon is wound after transferring, and a guide roller 23 for guiding the ink ribbon to the ribbon winding shaft 22 after transferring. Further, an engagement portion 18*a* that engages with a roller shaft 111 of the platen roller 11 attached to the body frame 16 is provided at the upper frame 18, and in the closed state as shown in FIG. 1, the engagement portion 18*a* and the roller shaft 111 of the platen roller 11 are engaged and the body frame 16 and the platen roller 11 are positioned.

The upper blade 13 of the cutter mechanism is attached, via an upper blade holder 24, to an upper cover 25 for opening and closing an upper portion of the body frame 16. The upper cover 25 is supported to be freely rotatable by the support shaft 19 provided in the rear side of the body frame 16, similarly to the upper frame 18. Thus, the upper cover 25 can be opened in a direction in which the upper blade 13 is separated from the lower blade 14 attached to the body frame 16.

The upper blade holder 24, to which the upper blade 13 is attached, functions as a contact preventing means for preventing contact between the upper blade 13 and the upper frame 18 when the upper cover 25 is opened, and is supported to be freely rotatable by a support shaft 26 provided at the upper cover 25 and is biased by a spring 27 serving as biasing means in a direction of contact with a positioning piece 25*a* formed on the upper cover 25. Further, the upper blade holder 24 is provided with a sliding contact piece 28 that slidably contacts with the upper frame 18 when the upper frame 18 and the upper cover 25 are independently rotated.

Referring to FIGS. 3A and 3B, a latch piece 29 for integrating the upper cover 25 and the upper frame 18 in the closed state as shown in FIG. 1 is provided at the engagement portion 18*a* of the upper frame 18. An acting portion 29*a*, which is moved by the roller shaft 111 when the engagement portion 18*a* is engaged with the roller shaft 111 of the platen roller 11, and a clasp portion 29*b* are formed on the latch piece 29, one at either side of a rotary shaft 29*c*, so as to be rotatable about the rotary shaft 29*c*. When no external force acts on the acting portion 29*a*, the latch piece 29 is biased by biasing means such as a spring, which is not shown in the drawings, in a direction shown by an arrow B in FIG. 3A, whereby the acting portion 29*a* projects from an engagement surface of the engagement portion 18*a* and the roller shaft 111 and is held in this position, as shown in FIG. 3A.

In the closed state as shown in FIG. 1, the upper frame 18 is locked to the body frame 16 by a lock mechanism, which is not shown in the drawings, and the acting portion 29*a* of the latch portion 29 provided at the engagement portion 18*a* of the upper frame 18 is moved by the roller shaft 111 and rotates about the rotary shaft 29*c*, as shown in FIG. 3B. As a result, the clasp portion 29*b* is latched to a projecting portion 28*a* formed on the sliding contact piece 28 of the upper blade holder 24, and the upper frame 18 and the upper cover 25 are integrated. When the upper frame 18 and the upper cover 25 are integrated in this manner, the upper blade holder 24 is positioned by contacting with the positioning piece 25*a* due to the spring 27, whereby the upper blade 13 attached to the upper blade holder 24 is positioned relative to the lower blade 14 provided in the body frame 16. By causing the lower blade 14 to advance and retreat relative to the upper blade 13 in this state, the printing medium can be cut.

By operating a release lever, which is not shown in the drawings, for releasing the lock between the upper frame 18 and the body frame 16, the upper cover 25 and the upper frame 18 become rotatable about the support shaft 19 provided in the rear side of the body frame 16 in an integrated state, or in other words a state in which the sliding contact piece 28 is latched by the latch portion 29 provided at the engagement portion 18*a*. Hence, as shown in FIG. 4, the thermal head 12 can be separated from the platen roller 11, and the upper blade 13 can be separated from the lower blade 14. When the upper cover 25 is opened by integrally rotating the upper frame 18 and the upper cover 25 in this manner, a wide opening can be formed between the body frame 16 and the upper frame 18 and the upper cover 25, and therefore the sheet roll 17 can be easily loaded into the supply portion 16*a* of the body frame 16 through the gap between the body frame 16 and the upper frame 18 and the upper cover 25. Moreover, the printing medium can be drawn from the sheet roll 17 which is loaded into the supply portion 16*a*, and the drawn printing medium can be easily set on the upper portion of the platen roller 11 and the lower blade 14.

Further, the upper cover 25 and the upper frame 18 can be rotated independently about the support shaft 19 provided in the rear side of the body frame 16. More specifically, when a force is applied in a direction of moving the upper cover 25 and the upper frame 18 apart, or in other words when the upper cover 25 and the upper frame 18 are rotated in opposite directions about the support shaft 19 provided in the rear side of the body frame 16, the latch formed between the clasp portion 29*b* of the latch portion 29 and the projecting portion 28*a* of the sliding contact piece 28 is released as shown in FIG. 3A, and the sliding contact piece 28 slidably contacts the upper frame 18 as shown in FIG. 5, whereby the upper blade holder 24 is pivoted in a direction shown by an arrow A in FIG. 5 against the biasing force of the spring 27, i.e., the upper blade 13 attached to the upper blade holder 24 is pivoted in a direction separating away from the upper frame 18. As a result, a wide opening can be formed between the upper cover 25 and the upper frame 18 while avoiding contact between the upper frame 18 and the upper blade 13, as shown in FIG. 6. Hence, cleaning and other maintenance of the thermal head 12 provided in the upper frame 18 and replacement of the ink ribbon can be performed without interference from the upper cover 25 (the upper blade 13).

As described above, according to the present embodiment, by providing the main body frame 16 provided with the lower blade 14, and the upper cover 25 provided with the upper blade 13 and opens and closes the upper portion of the main body frame 16, in a configuration such that the upper blade 13 is separated from the lower blade 14 when the upper cover 25 is opened, a wide opening can be formed between the upper blade 13 and the lower blade 14 when the upper cover 25 is opened, which results in an effect such that the strip-form printing medium can be easily set without performing a complicate operation to pass the printing medium through a gap between the upper blade 13 and lower blade 14 of the cutter mechanism.

Further, according to the present embodiment, by attaching the upper cover 25 and the upper frame 18, which is provided between the upper cover 25 and the main body frame 16 and provided with the thermal head 11 and the ink ribbon conveyance mechanism, to be rotatable about the single support shaft 19 provided in the main body frame 16, and providing the integrating means (the latch portion 29) for integrating the upper cover 25 and the upper frame 18, the upper cover 25 and the upper frame 18 can be integrally rotated due to the integration by the integrating means (latch portion 29), and can be independently rotated by releasing the integration by the integrating means (latch portion 29). Thus, a wide opening can be formed between the main body frame 16 and the upper cover 25 and the upper frame 18 when the upper cover 25 and upper frame 18 are integrally rotated due to the integration by the integrating means (latch portion 29), whereby the sheet roll can be easily loaded into the supply portion 16*a* of the main body frame 16 through the gap between the main body frame 16 and the upper frame 18 and the upper cover 25, and a wide opening can be formed between the upper cover 25 and the upper frame 18 when the upper cover 25 and the upper frame 18 are independently rotated by releasing the integration by the integrating means (latch portion 29), whereby a cleaning operation of the thermal head 11 and a replacement operation of an ink ribbon can be performed at a position where is not being interfered with the upper blade 13 attached to the upper cover 25, which results in an effect of enabling an improvement in maintenance workability.

Furthermore, according to the present embodiment, the upper blade 13 is attached to the upper blade holder 24, and the sliding contact piece 28 that slidably contacts the upper frame 18 when the upper cover 25 and the upper frame 18 are independently rotated is provided at the upper blade holder 24. Hence, when the sliding contact piece 28 slidably contacts the upper frame 18, the upper blade holder 24 is pivoted due to an external force from the upper frame 18 and the upper cover 25 and the upper frame 18 can be separated while avoiding contact between the upper blade 13 and the upper frame 18. Therefore, the shape of the upper frame 18 is not restricted by the trajectory of the upper blade 13 when opening the upper cover 25, and as a result, an effect of improvement in design freedom can be achieved.

Note that the present invention is not limited to the embodiments described above, and each embodiment may be modified appropriately within the scope of the technical spirit of the present invention. Furthermore, the numbers, positions, shapes, and the like of the respective components are not limited to those described in the embodiments, and may be modified appropriately for the purpose of implementing the present invention. It should be also noted that in the drawings, identical components are allocated identical reference symbols.

The invention claimed is:

1. A label printer having a cutter mechanism that includes an upper blade which is a fixed blade and a lower blade which is a moving blade that advances and retreats relative to the upper blade, and that cuts a printing medium by causing the lower blade to advance and retreat relative to the upper blade, the label printer comprising:

a main body frame to which the lower blade is attached;

an upper cover to which the upper blade is attached, and that opens and closes an upper portion of the main body frame;

an upper frame to which a thermal head is attached and which is provided between the upper cover and the main body frame;

an integrating unit that integrates the upper cover and the upper frame;

a support shaft that supports the upper cover and the upper frame so as to be rotatable with respect to the main body frame; and a contact preventing member that prevents the upper blade from contacting the upper frame by causing the upper blade to pivot, when the integration of the upper cover and the upper frame by the integrating unit is released and the upper cover and the upper frame are respectively rotated independently.

2. The label printer according to claim 1, wherein an ink ribbon conveyance mechanism is attached to the upper frame.

3. The label printer according to claim 2, wherein the contact preventing member further comprises an upper blade holder to which the upper blade is attached, the upper blade holder comprising:

a second support shaft that supports the upper blade holder pivotably or rotatable with respect to the upper cover;

a biasing member that biases the upper blade holder in a direction of contact with a positioning piece formed on the upper cover so that the upper blade is positioned relative to the lower blade; and a sliding contact piece that slidably contacts the upper frame and causes the upper blade holder to pivot in a direction separating away from the upper frame against the biasing force of the biasing member.

4. The label printer according to claim 3, further comprising a platen roller having a roller shaft, wherein the integrating unit comprises:

an acting portion that contacts the roller shaft and is moved by the roller shaft;

a clasp portion that is latched to a projecting portion formed on the sliding contact piece;

a rotary shaft formed between the acting portion and the clasp portion that rotatably supports the integrating unit; and a second biasing member that biases the clasp portion in a direction separating away from the projecting portion, wherein the upper cover and the upper frame are integrated by, in a state in which the upper cover and the upper frame are opened from the main body frame, causing the acting portion to contact the roller shaft, thereby rotating the clasp portion about the rotary shaft against the biasing force of the second biasing member, and causing the clasp portion to be latched to the projecting portion.

* * * * *